US005644097A

United States Patent [19]

Shimada

[11] Patent Number: 5,644,097

[45] Date of Patent: Jul. 1, 1997

[54] PERFORMANCE INFORMATION OUTPUT DEVICE AND AN AUTOMATIC PERFORMING SYSTEM PROVIDED WITH THE PERFORMANCE INFORMATION OUTPUT DEVICE

[75] Inventor: Yoshihisa Shimada, Hamamatsu, Japan

[73] Assignee: Kabushiki Kaisha Kawai Gakki Seisakusho, Shizuoka-Ken, Japan

[21] Appl. No.: 534,382

[22] Filed: Sep. 28, 1995

[30] Foreign Application Priority Data

Oct. 3, 1994 [JP] Japan ..... 6-239014
Oct. 3, 1994 [JP] Japan ..... 6-239015

[51] Int. Cl.[6] ..... G10H 1/00; G10H 7/00

[52] U.S. Cl. ..... 84/609; 84/645; 84/649

[58] Field of Search ..... 84/609–614, 634–638, 84/645, 649–652, 666–669

[56] References Cited

U.S. PATENT DOCUMENTS 5,414,209 5/1995 Morita ..... 84/645 X

*Primary Examiner*—Stanley J. Witkowski
*Attorney, Agent, or Firm*—Davis and Bujold

[57] ABSTRACT

An automatic performing system provided with a performance information output device that permits external sound sources or other to play a realistic performance by preventing delays in the performance. When the presently read performance data is control data and the MIDI output mode is set to an all data output mode or unrestricted output mode, if the presently read is control data coincides with the previously read control data, the present data is prevented from being transmitted to the external sound sources. If these control data do not coincide with each other, the present control data is converted to a MIDI signal and is transmitted. Although the present control data that coincide with the previous control data is not transmitted, the previous control data remains in the external sound sources. Therefore, the tone is the same as the tone that would be obtained if the present control data were transmitted. When the presently read data is control data and the MIDI output mode is set to output prohibition mode or restricted output mode, no control data is processed into MIDI output. In the restricted output mode, the quantity of MIDI signal to be serially transferred to the outside is restricted, thereby reducing the time period of transfer. Furthermore, delay in the performance of external sound sources can be eliminated.

18 Claims, 8 Drawing Sheets

PERFORMANCE INFORMATION OUTPUT DEVICE AND AN AUTOMATIC PERFORMING SYSTEM PROVIDED WITH THE PERFORMANCE INFORMATION OUTPUT DEVICE

FIELD OF THE INVENTION

This invention relates to a performance information output device for converting performance data into Musical Instrument Digital Interface (referred to MIDI hereinafter) signal and serially transferring the MIDI signal to external sound sources, an external sequencer or other external device, and to an automatic performing system provided with such an output device.

BACKGROUND OF THE INVENTION

Electronic keyboards and other electronic musical instruments provided with an automatic rhythm, chord or other accompaniment function are widely known. In such an electronic keyboard instrument, automatic accompaniment pattern data for each of rock, waltz and other rhythms is previously stored in a ROM or other storage device. The automatic accompaniment pattern data can be read for repeated performance.

The known electronic keyboard instrument is also provided with a MIDI terminal for transmitting and receiving keyboard performance information or automatic accompaniment information. By transmitting and receiving information to and from external instruments having a sound source and a sequencer, various instruments can be concurrently played. The MIDI referred to herein is a unified standard of communication procedure for electronic instruments.

Automatic accompaniment pattern data have recently achieved fairly realistic performance capabilities, by diversifying the sound source control information and other performance information and thereby enlarging the quantity of information for use in a performance. The sound source control information includes the information used for modifying fixed tones with operating elements other than the keyboard. Specifically, pan information for varying the position of sounds in the left to right direction, balance information for balancing sound volume in the left to right direction, expression information for accenting sounds having programmed volumes and the like are included.

Because of such vast performance information, when the external sound sources are sounded or sound is recorded into the external sequencer, by converting the automatic accompaniment pattern data into a MIDI signal and serially transferring the signal, for example, the performance of the external sound sources is delayed as compared with when the performance is created by deriving the sound signal directly from the automatic accompaniment pattern data without converting the data into a MIDI signal.

The MIDI signal character is composed of eight bit. The speed of transferring each bit is defined as 31.25 kbaud. As the quantity of information for use in the performance is increased, the number of MIDI signal characters is increased. Therefore, it takes time for the automatic accompaniment pattern data to be serially transferred. For this reason, the performance of external sound sources is executed with a delay. Especially, concurrency between the performance of a performing system transmitting a MIDI signal and that of a performing system receiving a MIDI signal is impaired.

SUMMARY OF THE INVENTION

Wherefore, an object of this invention is to provide a performance information output device and an automatic performing system provided with an output device that permits external sound sources or other sources to play realistic performances without delay.

Another object of the invention is to provide a performance information output device and an automatic performing system provided with an output device that permits the performance of external sound sources or other sources to accompany the original performance without delay, even while the performance data is converted into a MIDI signal and the signal is serially transmitted to the external sound sources or other.

To attain these or other objects, the invention provides a performance information output device for converting the performance data composed of sounding information and control information into a MIDI signal and serially transferring the MIDI signal to external sound sources, an external sequencer or other. As shown in FIG. 1, the performance information output device is composed of a performance data memory M1 for storing the performance data and a reading unit M2 for sequentially reading the performance data from the memory M1. When the performance data presently read by the reading unit is control information, a comparison unit M3 compares the presently read control information with the previously read control information. As a result of the comparison by the comparison unit M3, when the presently read control information coincides with the last previously read control information, the presently read control information is prevented from being transmitted to external sound sources or other by an output control M4. If the presently read control information does not coincide with the previously read control information, the presently read control information is transmitted outside by the output control M4.

The invention further provides an automatic performing system, provided with the performance information output device, with a sound generating unit for deriving a sound signal directly from an internal sound source and for generating sound based on the performance data sequentially read by the reading unit M2.

In the performance information output device, the performance data is sequentially read from the performance data memory M1 by the reading unit M2. The performance data is converted into a MIDI signal and the signal is serially transferred to the external sound sources, the external sequencer or other. The performance data includes at least sounding information and control information.

When the performance data presently read by the reading unit M2 is control information, the comparison unit M3 compares the presently read control information with the previously read control information. If the present information coincides with the previous information, the present control information is prevented from being transmitted by the output control M4. The control information is then maintained as it presently exists in the external sound sources. Consequently, the obtained tone is identical to the tone that would be obtained if the present control information was transmitted. If the present information differs from the previous information, the present information is transmitted by the output control M4.

As aforementioned, even when the control information is selectively transmitted, a realistic performance is executed by the external sound sources or other with the same quality as when all the control information is transmitted outside. Furthermore, the quantity of MIDI signals to be processed by the external sound sources or other is reduced. Consequently, the performance of the external sound sources or other can accompany the original performance without delay. The control information is used for modifying the predetermined tone with operating elements other than the keyboard, and is not absolutely necessary for the sounding of the external sound sources or other.

When the automatic performing system provided with the performance information output device has an internal sound source, the performance of the external sound sources does not deviate from the performance of the internal sound source or other, based on the same performance information.

As shown in FIG. 2, the invention also provides a performance information output device for converting performance data M101 composed of at least sounding information and control information into a MIDI signal M102 and serially transferring the MIDI signal to external sound sources, an external sequencer or other. The performance information output device is composed of an output mode setting unit M103 for setting an optional mode among a plurality of modes, including a restricted output mode. An output control M104 serially transmits the performance data M101 with restriction when the restricted output mode is set by the output mode setting unit M103.

In the performance information output device, the performance data composed of at least sounding information and control information is converted to a MIDI signal M102 and the MIDI signal is serially transferred to the external sound sources, the external sequencer and the like. When the restricted output mode is set by the output mode setting unit M103, the performance data M101 is serially transferred with restriction by the output control M104. In the performance information output device, the quantity of MIDI signals to be serially transferred is reduced by restricting the performance data M101 that is converted to a MIDI signal and transferred, thereby shortening the transfer time period. As a result of the shortened transfer time period, no delay is caused in the performance of the external sound sources using the MIDI signal as compared with a performance played by deriving the sound signal directly from the performance data.

In the restricted output mode, certain types of control information included in the performance data may be prevented from being transmitted by the output control M104 altogether, regardless of whether or not the present control information differs from the previous control information. For example, if certain control functions can be set by the external sound sources or other per se, no corresponding control information needs to he transmitted to the external sound sources or other. Alternatively, if certain control functions are not provided in the external sound sources or other, information regarding the non-existent control functions is not required for the external sound sources. Therefore, the performance information output device can be constructed such that predetermined types of control information are prevented from being transmitted. For example, control information for use in modification of fixed tones using an operating element other than the keyboard is not absolutely necessary for the sounding of external sound sources or other.

The output control M104 can alternatively transmit all of the performance data M101, when the unrestricted output mode is set. In operation, an operator first sets the output control to the unrestricted output mode, thereby transmitting MIDI signals to the external sound sources or other. If no delay occurs in the performance of external sound sources or other, the set mode need not be switched to the other mode. If a delay does occur in the performance, then the mode is preferably changed over to the restricted output mode, so as to eliminate the delay. Therefore, when the unrestricted output mode is set, realistic performances can be provided. If a delay occurs in the performance of the external sound sources or other, priority is given to the elimination of the delay by switching to the restricted output mode, rather than to the realization of a realistic performance.

The automatic performing system, provided with the aforementioned performance information device, has the aforementioned action and effect. Furthermore, when the internal sound source of the automatic performing system and the external sound sources or other are played based on the same performance data M101, no discrepancies in performance are caused between these sources.

BRIEF DESCRIPTION OF THE DRAWINGS

The invention will now be described, by way of example, with reference to the drawings, in which.

DETAILED DESCRIPTION OF THE PREFERRED EMBODIMENT

Figure 1:
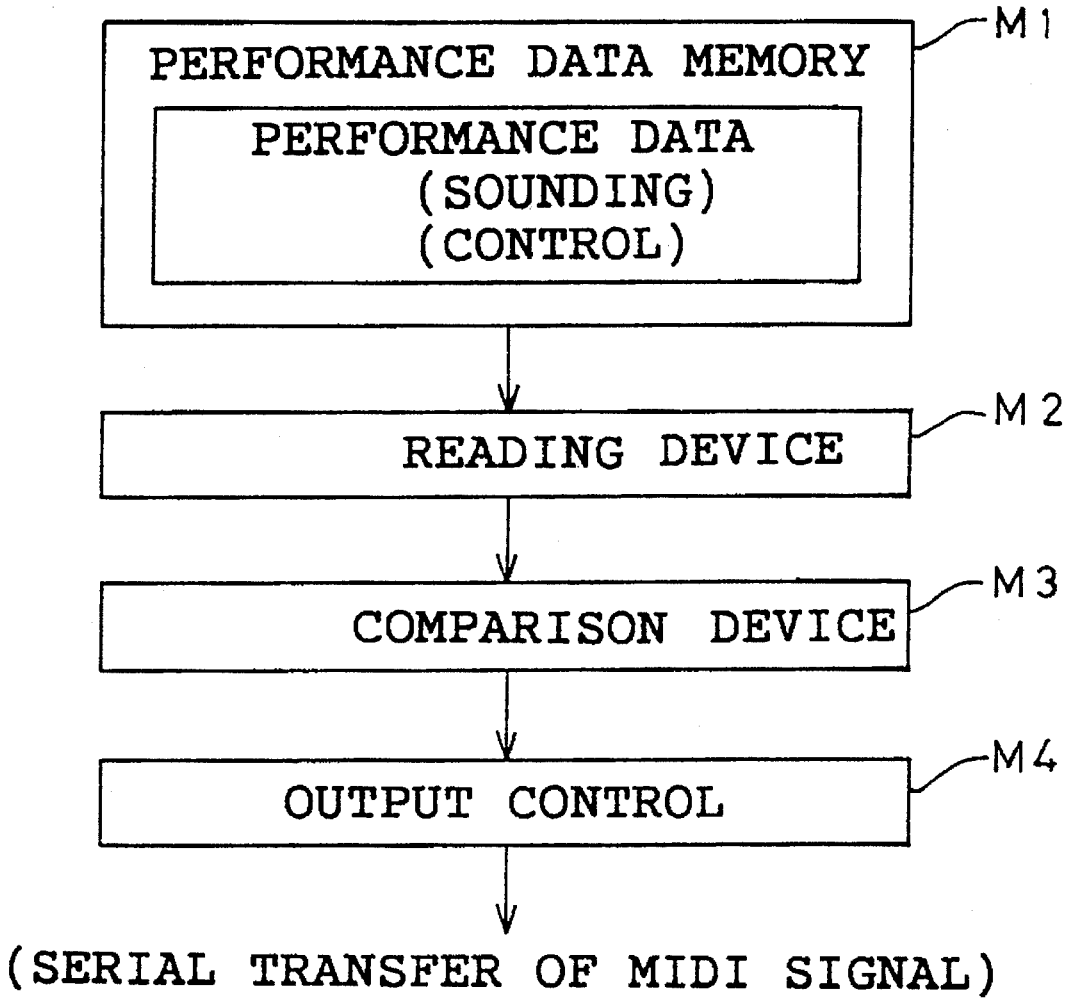
FIGS. 1 and 2 illustrate the basic structure of a performance information device embodying the invention.
Figure 2:
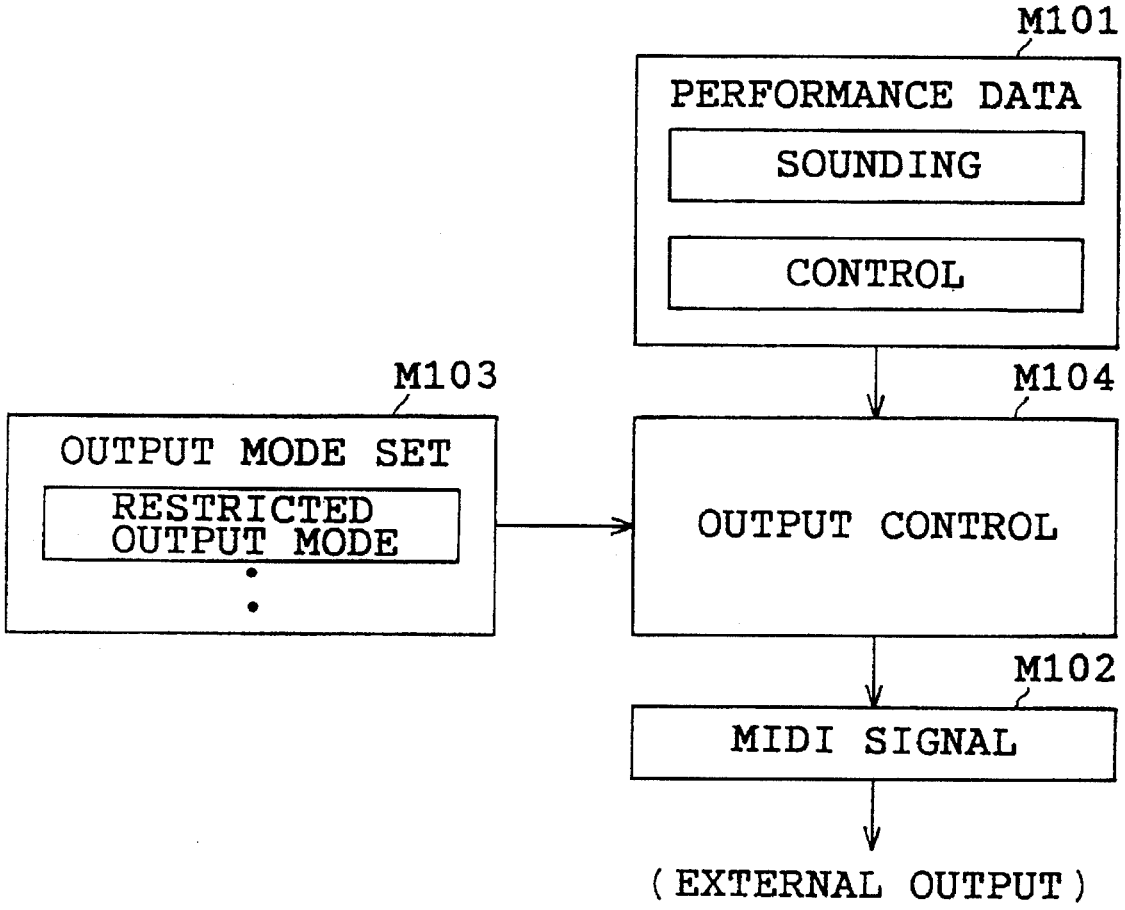
Figure 3:
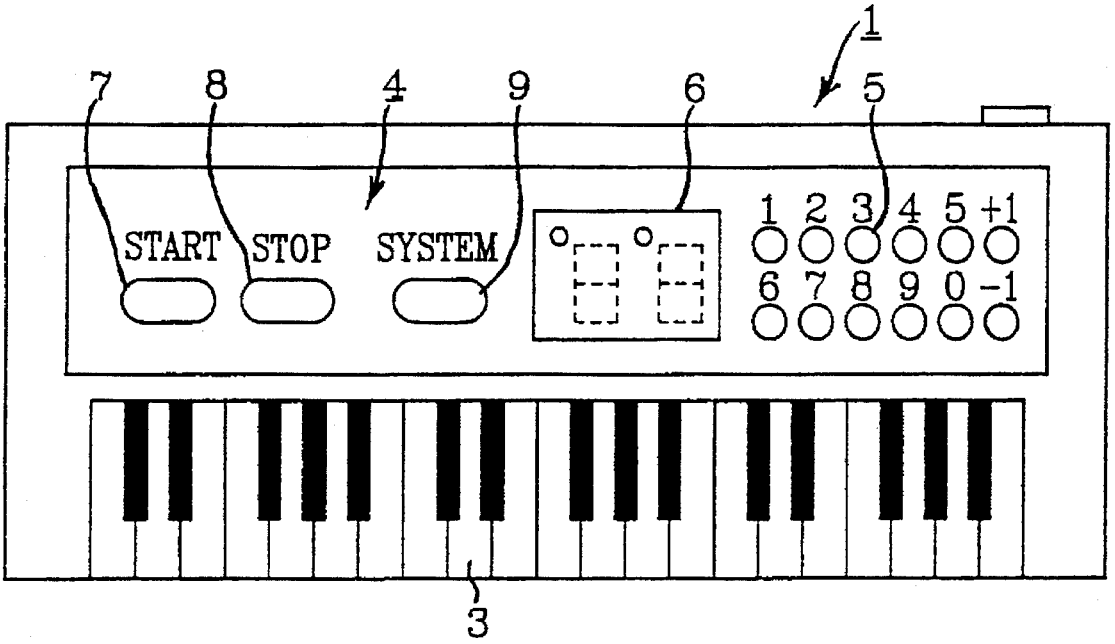
FIG. 3 diagrammatically illustrates an electronic keyboard embodying the invention.

An electronic keyboard 1 embodying the invention for automatic accompaniment based on automatic accompaniment data or performance data stored in a ROM is illustrated in FIGS. 1–4. The electronic keyboard 1, as shown in FIG. 3, is provided with a conventional keyboard 3 with a plurality of white and black keys arranged thereon and an operation panel 4 with a plurality of operating switches arranged thereon for selecting the various automatic accompaniment. The operation panel 4 is provided with a not-shown power on/off switch, numerical switches 5 for setting rook, waltz or other accompaniment rhythm, volume and tone, a display 6 for displaying the numerical value entered with the numerical switches 5, a start switch 7 for starting automatic accompaniment, a stop switch 8 for ending the automatic accompaniment, and a system mode switch 9 for setting the output mode for outputting a MIDI signal.

Figure 4:
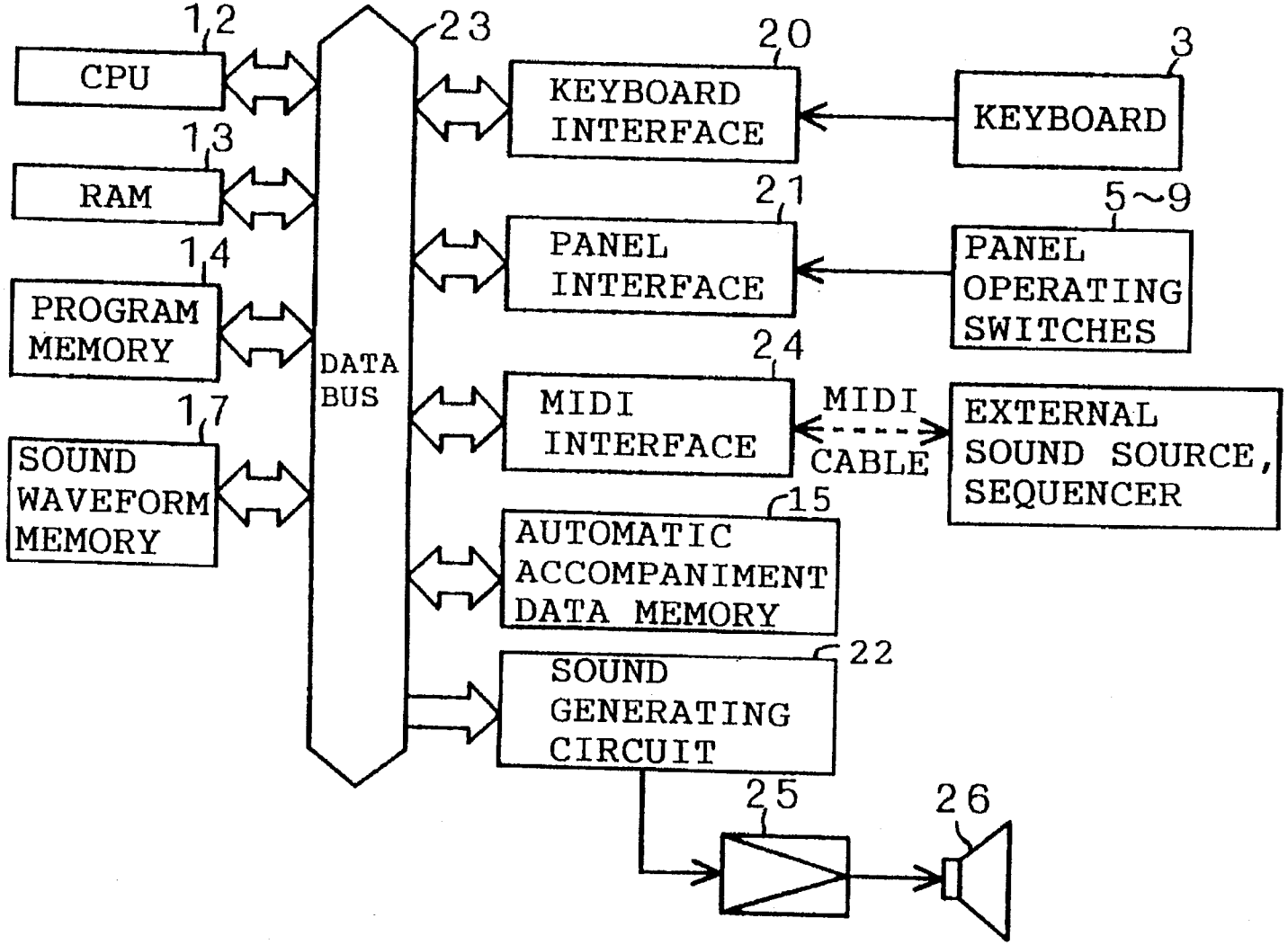
FIG. 4 is a block diagram showing the electric structure of the electronic keyboard.

As shown in FIG. 4, the main controller of the electronic keyboard 1 is composed of a CPU 12 for executing various operations, RAM 13 for temporarily storing various data, a program memory 14 for storing control and other programs, an automatic accompaniment data memory 15 and a sound waveform memory 17. The main controller is further composed of a keyboard interface 20 connected to the keyboard 3, a panel interface 21 connected to the respective operating switches 5–9, a MIDI interface 24 connected via MIDI cable(s) to external sound sources or an external sequencer, and sound signal generating circuit 22. These components are interconnected via a data bus 23.

The keyboard interface 20 has a circuit for detecting the depression and release of keys on the keyboard 3. The panel interface 21 has a circuit for detecting the switching on and off of operating switches 5–9 on the operation panel 4. The sound signal generating circuit 22 has a circuit for generating sound signals based on sound waveform data read from the sound waveform memory 17 corresponding to the operation of the keys and to the automatic accompaniment data. The sound signal is transmitted through an amplifier 25 to a loudspeaker 26 for sound emission. The MIDI interface 24 has a circuit for converting the automatic accompaniment data into MIDI format and transmitting a corresponding MIDI signal to external sources and other.

The automatic accompaniment data stored in the automatic accompaniment data memory 15 includes introduction data of an opening section of a performance of a musical composition, fill-in data of the fill-in pattern inserted in the midst of the composition, ending data of the performance pattern at the end of the composition, control data for each rhythm, such as rock, waltz and other, and basic pattern data. Automatic accompaniment data is provided for every part such as piano, strings, base and other.

The basic pattern data of one part consisting of, for example, four bars, has the tone data indicating the tone of the part at its top, and subsequently has the sounding data sequentially arranged for designating each subsequently emitted note. The sounding data includes four bytes: key number indicating a basically set sound pitch, step time indicating sounding timing, gate time indicating the duration of sounding and velocity indicating sounding intensity or volume.

The control data for modifying the fixed note in a channel corresponding to the desired external sound source is appropriately added in the basic pattern data. The control data includes, for example, pan information for varying the position of sound in the left to right direction, balance information for balancing sound volume in the left to right direction, expression information for accenting sound having a programmed volume and the like. The control data is composed of four bytes in total, including control number and step time. In the embodiment, the aforementioned tone data is processed as part of the control data.

An end mark, composed of two bytes including the step time, is arranged at the end of the data of each accompaniment part.

The introduction data, the fill-in data and the ending data each have a structure almost identical to that of the aforementioned basic pattern data.

The MIDI signal to be serially transferred to the external sound sources or other is now explained. The MIDI signal is character data composed of eight bits and the performance information is expressed in MIDI format by combining three bytes of character data, as shown in Table 1. The first byte corresponding to a status byte and the second and third byte corresponding to two data bytes, indicating note number of a key and the velocity of depression or release of the key, respectively. The status byte indicates note-on, note-off, control change, program change or other status. The status byte is also composed of a channel code indicating which instrument the individual event data corresponds to. When the status byte indicates note-on or note-off, the note number data byte indicating keys of the keyboard and the velocity data byte indicating the speed of depressing or releasing the keys are set in the data bytes. When the status byte indicates the control change, the control number byte or other is included in the data byte.

TABLE 1

| | MIDI MESSAGE | | |
|---|---|---|---|
| BYTE DIVISION | BYTE TYPE | CONTENT | REMARKS |
| FIRST BYTE | STATUS | 9nH: NOTE ON<br>8nH: NOTE OFF | n CORRESPONDS TO 0 TO F<br>OH TO FH INDICATES CHANNEL |
| SECOND BYTE | NOTE NUMBER | 00 TO 7FH | 3CH INDICATES THE CENTER OF THE PIANO<br>C DENOTES NOTE DO |
| THIRD BYTE | VELOCITY | 00 TO 7FH | SPEED OF DEPRESSING AND RELEASING KEYS |

Figure 5:
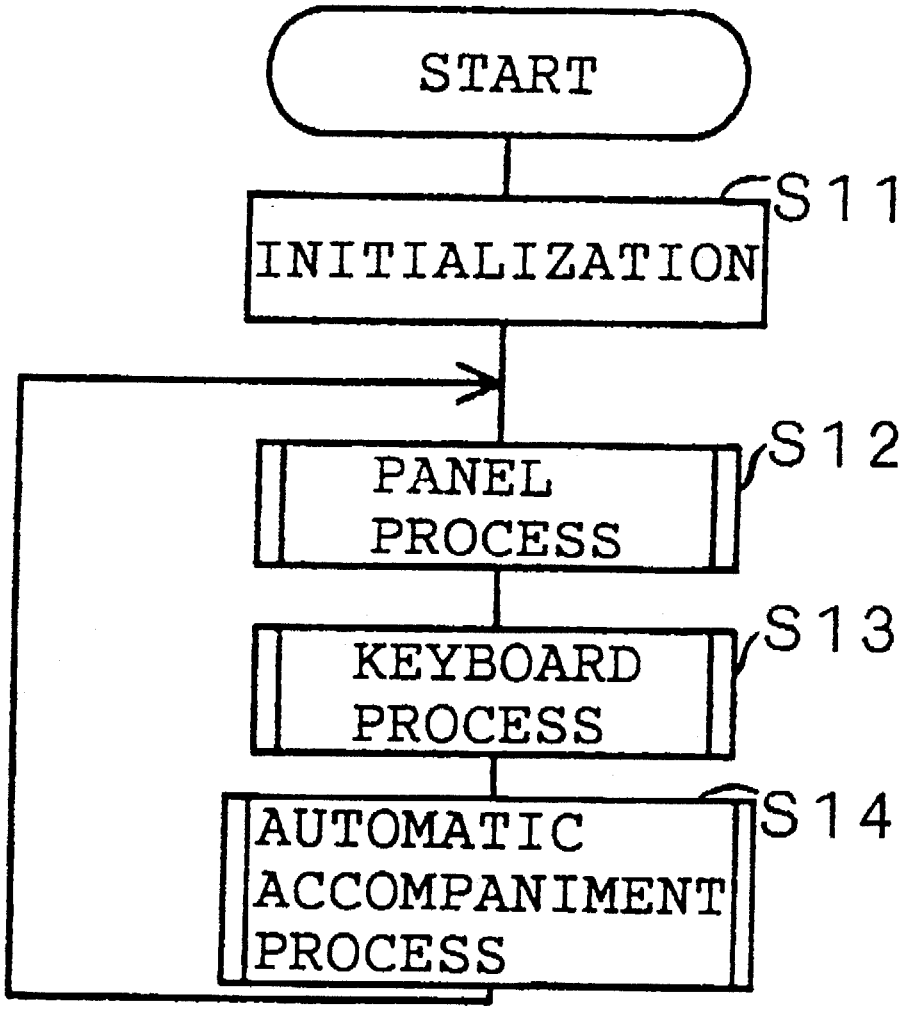
FIG. 5 is a flowchart of the main routine of the electronic keyboard.

The main routine of the electronic keyboard, as shown in the flowchart of FIG. 5, is started and executed when the not-shown power switch provided on the keyboard 1 is turned on. First at step S11, initialization is carried out, for example, by clearing the RAM 13, thereby preparing the electronic keyboard for the following processes. Subsequently, the process sequentially goes to step S12 of the panel process, S13 of the keyboard process and S14 of the automatic accompaniment process, and steps S12, S13 and S14 are repeatedly executed.

Figure 6:
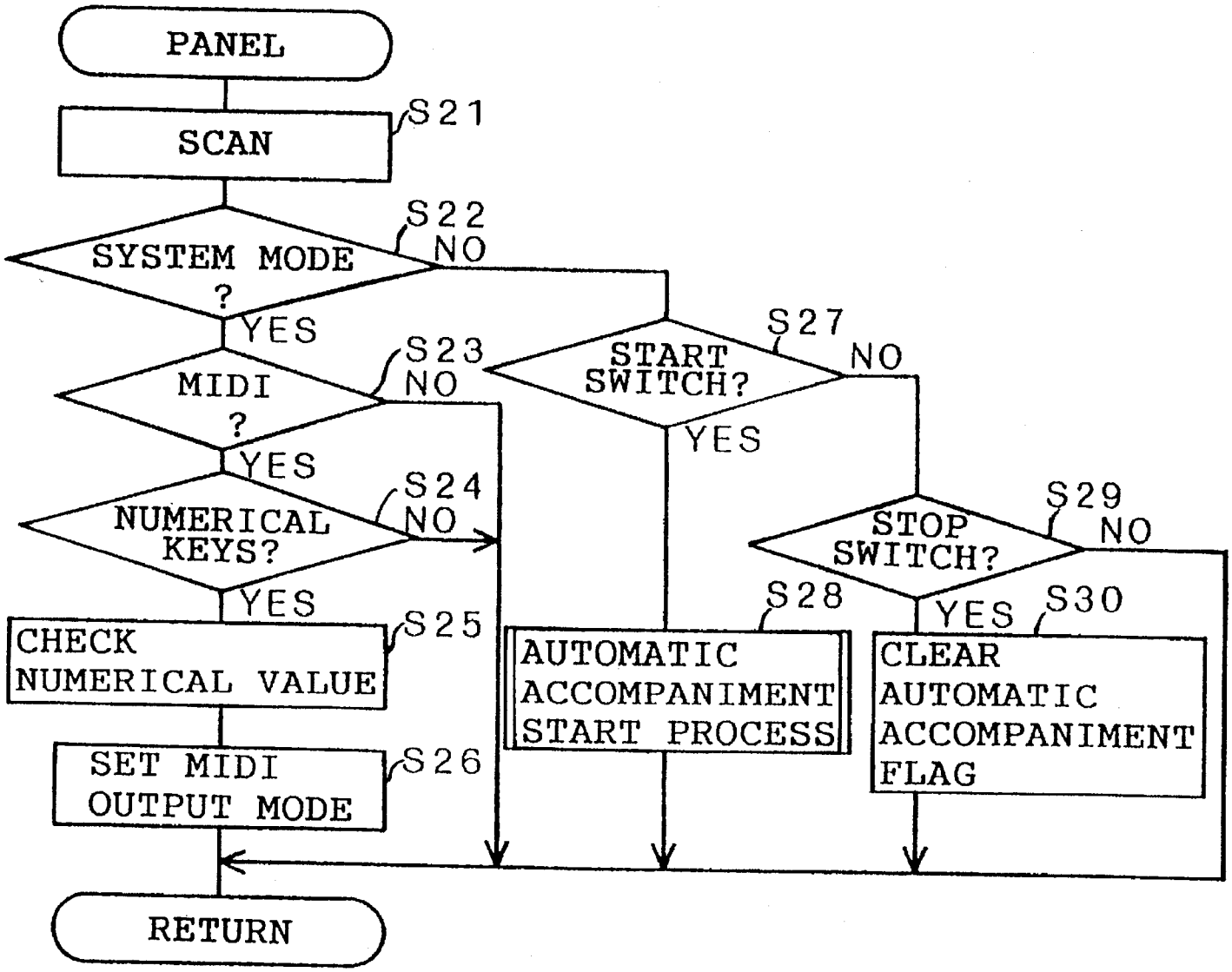
FIG. 6 is a flowchart of the panel process.

The panel process is now explained referring to FIG. 6. When the panel process is started, the operation panel is scanned to detect the on/off condition of the panel operating switches 5 thru 9 at step S21. Subsequently, it is determined at S22 whether or not the system mode switch 9 is turned on. When the system mode switch 9 is turned on, it is determined at S23 whether or not a MIDI mode is set. When a MIDI mode is not set, the process ends. When a MIDI mode is set, it is determined at S24, whether or not a numerical value is entered with numerical switches 5. When no numerical value entered, the process ends. When a numerical value entered, it is checked at S25 which numerical value entered, 0, 1 or 2. When numerical value 0 is entered, the output prohibition mode is set. Numerical value 1 indicates all data output mode or unrestricted output mode, and numerical value 2 indicates the restricted output mode. After the MIDI output mode is set, the process ends.

When it is determined at step S22 that the system mode switch 9 is off, it is determined at step S27 whether or not the automatic accompaniment start switch 7 is turned on. When the start switch 7 is on, the automatic accompaniment start process detailed later is executed at step S28. When the start switch 7 is off, it is determined at step S29 whether or not the automatic accompaniment stop switch 8 is turned on. When the stop switch 8 is on, the automatic accompaniment flag is cleared at step S30. When the stop switch 8 is off, the process ends.

Figure 7:
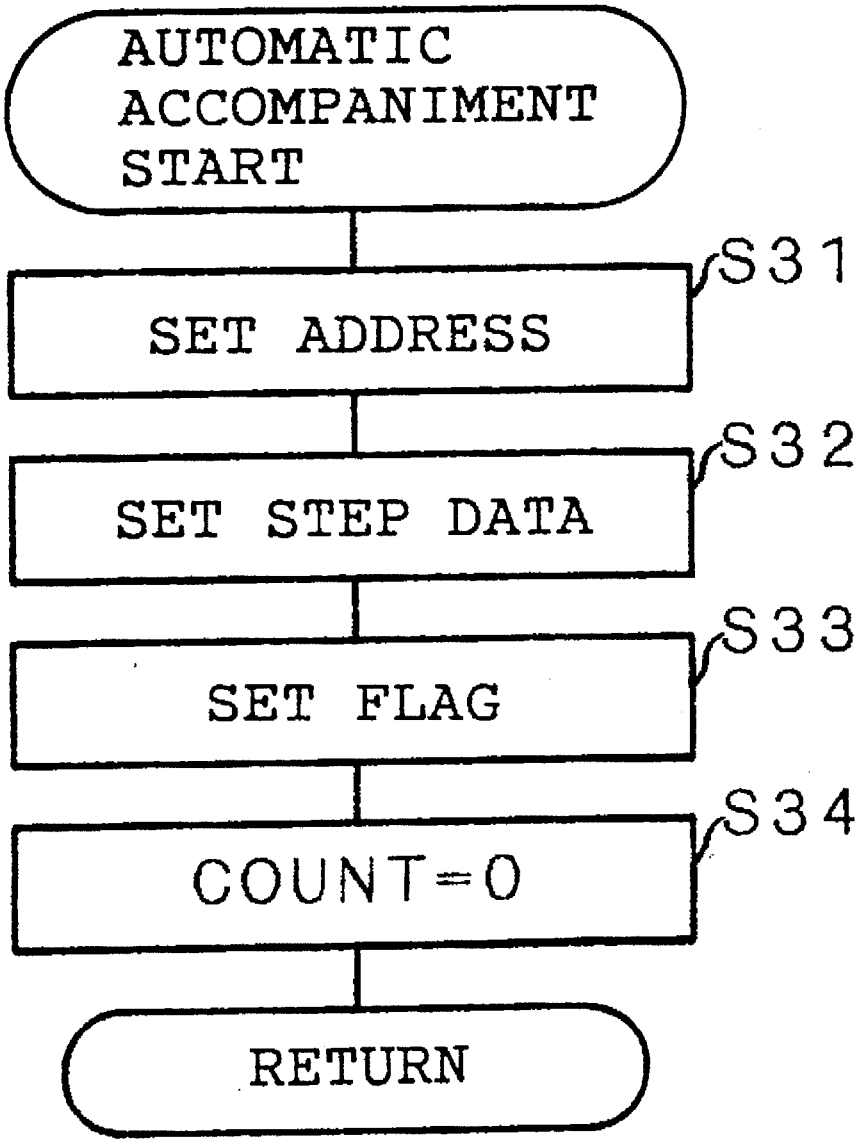
FIG. 7 is a flowchart for starting automatic accompaniment.

The automatic accompaniment start process is now explained referring to FIG. 7. When the automatic accompaniment process is started, the address of the top of automatic accompaniment data stored in the memory 15 is set at step S31. As aforementioned, the automatic accompaniment data includes four bytes of sounding data for each note, four bytes of control data for a certain channel and two bytes of end mark. After the top address is set, the step data is read at step S32, thereby setting the step time or sound emission duration. Subsequently, at step S33 an automatic accompaniment flag is set and at step S34 the numerical value on a counter is cleared to zero.

Figure 8:
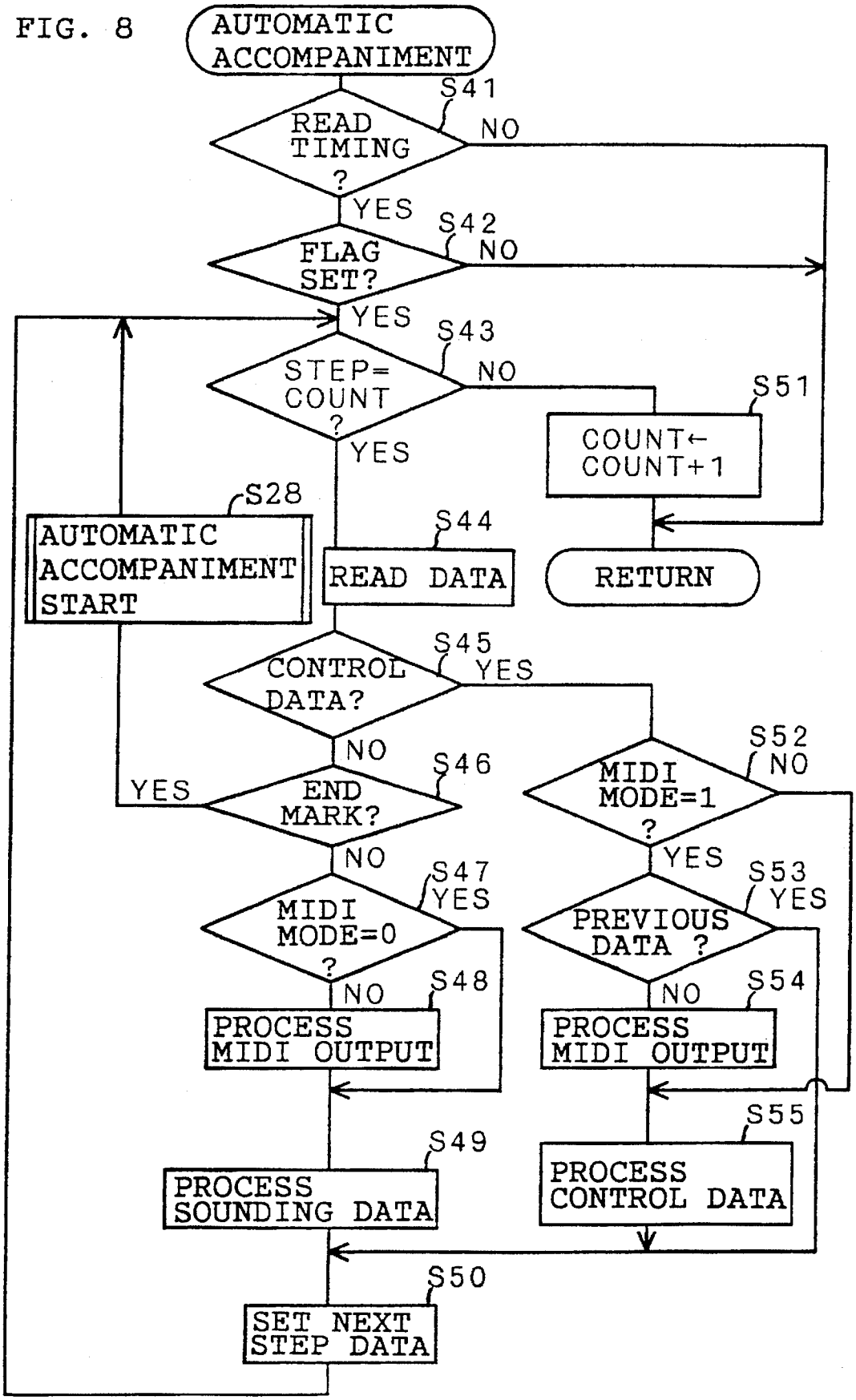
FIG. 8 is a flowchart of the automatic accompaniment process.

The automatic accompaniment process is now explained referring to the flowchart of FIG. 8. After the process is started, first at step S41 it is determined whether or not it is read timing. Read timing means the point in time when one over twenty four (1/24) of the duration of a quarter note has elapsed on a timer. When it is not read timing, the process once ends. When it is read timing, it is determined at step S42 whether or not the automatic accompaniment flag is set. When the flag is not set, the process ends. When the flag is set, at step S43 the step time is compared with the numerical value on the counter. When the step time does not coincide with the counter value, the counter is incremented up by one(1) at step S51 and the process once ends. When both coincide with each other, at step S44 the automatic accompaniment data is read and it is determined at step S45 whether or not the read automatic accompaniment data is control data by checking the first byte of the automatic accompaniment data.

When, as a result of checking the first byte of the read data, it is ascertained that the data is not control data, it is determined at step S46 whether or not the data is an end mark. An end mark indicates that all the performance data of four bars has been processed. Therefore, when the data is determined to be an end mark at step S46, the automatic accompaniment start process is executed at step S28, thereby returning back to the top of the four bars. Thus, step S43 and the subsequent steps are repeatedly executed. When it is determined at step S46 that the data is not an end mark, the read data must be sounding data. Therefore, it is determined at step S47 whether or not the MIDI output mode is "0", i.e. output prohibition mode. When it is determined that the output mode equals "0", the process goes to step S49, instead of processing the MIDI output. When it is determined at step S47 that the output mode is not "0", it is known that the output mode is set to either the all data unrestricted output mode or the restricted output mode. In either mode, the process goes to step 848 of processing MIDI output, at which the sounding data is converted to a MIDI format signal and the signal is serially transmitted via the MIDI interface to the external sound sources or other.

The process subsequently goes to step S49, thereby processing the sounding data such that sound is emitted from the loudspeaker 26 of the electronic keyboard 1. In the sounding data process, the sound signal is generated by the sound generating circuit 22 based on the sound waveform data read from the sound waveform memory 17 corresponding to the sounding data. The sound signal is transmitted to the amplifier 25, thereby emitting sound out of the loudspeaker 26.

Turning back to step S45, when it is determined by identifying the first byte of the data read at step S44 that the data is control data, it is determined at step S52 whether or not the MIDI Output mode is "1", i.e. all data output mode or unrestricted output mode. When the MIDI output mode is "1", the presently read control data is compared with the previously read control data at step S53. The previous control data is temporarily stored in RAM When at step S53 the present control data does not coincide with the previous control data, the process goes to step S54 of processing MIDI output. Specifically, the present control data is converted to a MIDI format signal and the signal is transmitted outside via the MIDI interface. Subsequently, at step S55 the control data is processed such that sound is emitted out of the loudspeaker 26 of the electronic keyboard 1. By processing the control data, the sound signal is directly derived from the automatic accompaniment data for sound emission out of the loudspeaker 26 of the keyboard 1. Therefore, the performance data can be more quickly processed as compared with the performance data based on a MIDI signal from an external sound source.

Turning back to step S53, when the present control data coincides with the previous control data, the process goes to step S50, without routing to step S54 of processing MIDI output or step S55 of processing the control data. Since the previous control data remains in the external sound sources to be processed thereby, it is not necessary to transmit the present control data. Consequently, a tone almost identical to the tone obtained by processing the present control data is emitted. The present control data is likewise not required for the sound emission of the loudspeaker 26 of the electronic keyboard 1, thereby obviating the necessity of executing step S55 of processing the control data.

After the aforementioned step S49 of processing the sound data is executed, after the step S55 of processing the control data is executed, or when it is determined at step S53 that the present control data coincides with the previous control data, the process then goes to step S50 at which the next step data is set. A loop of the steps including and following the step S43 is again executed.

As aforementioned, in the electronic keyboard 1 of the embodiment, when the output prohibition mode "0" is set, an affirmative determination is made at step S47 and a negative determination is made at step S52. For the sounding data or the control data, no MIDI output is processed. Therefore, no MIDI signal is transmitted to the external sound sources. Sound is emitted only from the loudspeaker 26 provided inside the electronic keyboard When all data output mode "1" is set, a negative determination is made at step S47 and an affirmative determination is made at step S52. For both the sounding data and the control data, MIDI output is processed. Therefore, sound is emitted from both the external sound sources and the loudspeaker 26 inside the electronic keyboard 1. In the all data output mode or unrestricted output mode, control data that is the same as the previously transmitted control data is not transmitted to external sound sources or other. However, a realistic performance is executed by the external sound sources in the same manner as when all the control data is transmitted outside. Furthermore, the quantity of MIDI signal to be processed by the external sound sources is reduced. Therefore, the performance of the external sound sources is prevented from being delayed and trailing in time behind the original performance as executed on the keyboard. Such effectiveness can be remarkable, especially when a vast quantity of control data is stored for realization of a realistic performance but the control data is not changed very frequently.

When the restricted output mode "2" is set, a negative determination is made at steps S47 and S52. MIDI output is only processed for the sounding information. Sound is emitted from both the external sound sources and the loudspeaker 26 inside the electronic keyboard 1. In the restricted output mode, even if a vast quantity of control data is stored for realization of a realistic performance, the quantity of MIDI signal to be serially transferred to the outside is reduced, thereby reducing the transfer time period. Delay in performance of the external sound sources can be eliminated. Such effectiveness is remarkable, especially when a vast quantity of control data is stored and the control data is frequently changed.

In the electronic keyboard 1, when the all data unrestricted output mode is set, the time discrepancies are eliminated in the performance between the loudspeaker 26 inside the electronic keyboard and the external sound sources. Furthermore, a realistic performance can be executed by the external sound sources, because changes in control information are transmitted to the external sound sources. In operation, an operator first sets the MIDI output mode to "1", i.e. the unrestricted output mode. While the MIDI signal is transmitted to the external sound sources, it is confirmed whether or not a delay in the performance of the external sound sources or other is caused. If no delay is caused, the MIDI output mode remains in the unrestricted output mode, thereby permitting the external sound sources to automatically perform the real accompaniment. If a delay occurs, the delay in the performance of the external sound sources can be eliminated by switching the MIDI output mode over to "2", i.e. the restricted output mode. Specifically, priority is given to elimination of such a delay rather than to a realistic performance by the external sound sources.

In the embodiment, when it is determined at step S52 that the MIDI mode is "1", the process goes to comparison step S53. When a negative determination is made at step S52, the process goes directly to step S55 of processing control data, skipping the comparison step S53 and the MIDI output step S54. Thus, in the restricted output mode of the embodiment, none of the control data included in the automatic accompaniment data is transmitted. Alternatively, unnecessary control data can be selected from the control data composed of pan, balance, expression and other data in the restricted mode and only the selected unnecessary data is prevented from being transmitted. For example, when a certain control function can be set by the external sound sources or other per se, the control data pertaining to this control function can be prevented from being transmitted. On the other hand, when the external sound sources or other is not provided with a certain control function, the control data pertaining to this control function, which is not required by the external sound sources, can be prevented from being transmitted outside. Such restrictions in the output of data can be selected by the operator. Alternatively, the restriction can be selected based on a determination by the CPU of the types of external sound sources or other.

This invention has been described above with reference to the preferred embodiment as shown in the figures. Modifications and alterations may become apparent to one skilled in the art upon reading and understanding the specification. Despite the use of the embodiment for illustration purposes, the invention is intended to include all such modifications and alterations within the spirit and scope of the appended claims.

What is claimed is:

1. A musical performance information output device for converting performance data, composed of at least sounding information and control information, into a MIDI signal and serially transferring the MIDI signal to at least one external device comprising at least one of an external sound source and a sequencer, said output device comprising:

performance data memory means for storing said performance data;

read means, coupled to said memory means, for serially reading said performance data stored in said memory means;

comparison means, coupled to said read means, for (i) determining if presently read performance data is control information, and for (ii), when it is determined that the presently read performance data is control information, comparing the presently read control information with a most recent previously read control information and determining whether the presently read control information coincides with the previously read control information; and output control means, coupled to said comparison means, for (i), when it is determined by said comparison means that the presently read control information coincides with the previously read control information, preventing the present read control information from being transmitted to said at least one external device, and for (ii), when it is determined by said comparison means that the presently read control information does not coincide with the previously read control information, converting the presently read control information to a corresponding MIDI signal and serially transferring the corresponding MIDI signal to said at least one external device.

2. A performance information output device according to claim 1, further comprising:

output mode set means for setting a restricted output mode; and when said restricted mode is set by said set means, said output control means converts only a restricted portion of the read performance data into a corresponding restricted MIDI signal and serially transfers only the restricted MIDI signal to at least one external device, thereby restricting the quantity of performance data that is converted into a MIDI signal and serially transferred to the at least one external device.

3. A performance information output device according to claim 2, wherein, when said restricted mode is set by said set means, said output control prevents all control information from being converted into a MIDI signal and transferred and only converts sounding data into said restricted MIDI signal.

4. A performance information output device according to claim 3, wherein said output set means further includes means for setting an output prohibition mode; and when the output prohibition mode is set by said set means, said output control means prevents all of the read performance information from being transferred to said at least one external device.

5. An automatic performing system including the performance information output device according to claim 1, said automatic performing system further comprising:

sound generating means for generating a sound signal directly from the performance data sequentially read by said read means and generating a corresponding sound with an internal sound source.

6. An automatic performing system including the performance information output device according to claim 4, said automatic performing system further comprising:

sound generating means for generating a sound signal directly from the performance data sequentially read by said read means and generating a corresponding sound with an internal sound source.

7. A performance information output device, for being electrically coupled with an automatic performing system and, when coupled with such a system, for serially receiving performance data, composed of at least sounding information and control information, from the automatic performing system, converting the received performance data into a MIDI signal, and serially transferring the MIDI signal to at least one external device comprising at least one of an external sound source and a sequencer, said output device comprising:

output mode set means for setting a desired output mode from a plurality of output modes, including an unrestricted output mode;

comparison means, for receiving said performance information from such a system and, when said unrestricted mode is set by said output mode set means, for (i) determining if presently received performance data is control information and (ii), when it is determined that the presently read performance data is control information, for comparing the presently received control information with a most recent previously received control information and determining whether the presently received control information coincides with the previously received control information; and output control means, coupled to said comparison means, for, when the unrestricted mode is set by the output mode set means:

(i) preventing the presently received control information from being transmitted to said at least one of external device, when it is determined by the comparison means that the presently read control information coincides with the previously received control information; and (ii) converting the presently received control information to a corresponding MIDI signal and serially transmitting the corresponding MIDI signal to said at least one external device, when it is determined by said comparison means that the presently received control information does not coincide with the previously received control information.

8. A performance information output device according to claim 7, wherein said plurality of output modes further includes a restricted output mode; and the output control means, when the restricted output mode is set by said output mode set means, converts only sounding information into a restricted MIDI signal, transmits only the restricted MIDI signal to said at least one external device, and prevents all of the control information from being transmitted to said at least one external device.

9. A performance information output device according to claim 7, wherein said plurality of output modes further includes a restricted output mode; and the output control means, when the restricted output mode is set by said output mode set means, converts only necessary received performance data into a corresponding restricted MIDI signal and serially transmits only the restricted MIDI signal to at least one external device and prevents unnecessary received performance information from being transmitted, thereby restricting the quantity of received performance data that is converted into a MIDI signal and serially transmitted to the at least one external device.

10. A performance information output device according to claim 9, wherein the output control means prevents control information that pertains to a control function that is not provided in the at least one external device, and therefore is unnecessary control information, from being transmitted.

11. A performance information output device according to claim 9, wherein the output control means prevents control information that pertains to a control function that can be set one of by the at least one external device, and therefore is unnecessary control information, from being transmitted.

12. A performance information output device according to claim 8, wherein said plurality of output modes further includes an output prohibition mode; and when the output prohibition mode is set by said output mode set means, said output control means prevents all of the received performance information from being transmitted to said at least one external device.

13. An automatic performing system including the performance information output device according to claim 7, said automatic performing system further comprising:

memory means for storing said performance data; and sound generating means for serially reading the performance data from the memory means, deriving a sound signal directly from the read performance data, and driving an internal sound source with the sound signal, thereby generating sound.

14. An automatic performing system including the performance information output device according to claim 8, said automatic performing system further comprising:

memory means for storing said performance data; and sound generating means for serially reading the performance data from the memory means, deriving a sound signal directly from the read performance data, and driving an internal sound source with the sound signal, thereby generating sound.

15. An automatic performing system including the performance information output device according to claim 12, said automatic performing system further comprising:

memory means for storing said performance data; and sound generating means for reading the performance data from the memory means, deriving a sound signal directly from the read performance data, and driving an internal sound source with the sound signal, thereby generating sound.

16. A method of converting musical performance data, composed of at least sounding information and control information, into a MIDI signal and serially transferring the MIDI signal to at least one device comprising at least one of a sound source and a sequencer, comprising the steps of:

(a) storing said performance data;

(b) serially reading said stored performance data;

(c) determining whether presently read performance data is control information;

(d) upon a determination that the presently read performance data is control information, comparing the presently read control information with a most recent previously read control information and determining whether the presently read control information coincides with the previously read control information; and (e) (i) upon a determination that the presently read control information coincides with the previously read control information, preventing the presently read control information from being transmitted to said at least one external device, and (ii) upon a determination that the presently read control information does not coincide with the previously read control information, converting the presently read control information to a corresponding MIDI signal and serially transmitting the corresponding MIDI signal to said at least one external device.

17. A method according to claim 16, further comprising the steps of:

selecting a restricted output mode; and when said restricted output mode is set by said set means, converting only a restricted portion of the read performance data into a corresponding restricted MIDI signal and serially transmitting only the restricted MIDI signal to at least one external device, thereby restricting the quantity of performance data that is converted into a MIDI signal and serially transmitted to the at least one external device.

18. A method according to claim 17, wherein said step of converting only a restricted portion of the read performance data, comprises the steps of:

converting only sounding information into said corresponding restricted MIDI signal and preventing all of the control information from being transmitted.

* * * * *